US009015970B1

(12) United States Patent
Doucette

(10) Patent No.: US 9,015,970 B1
(45) Date of Patent: Apr. 28, 2015

(54) CONVERTIBLE BUCKET HAVING FOLDING WINGS AND WINGLETS

(71) Applicant: Paul Doucette, Waller, TX (US)

(72) Inventor: Paul Doucette, Waller, TX (US)

(73) Assignee: Northland Leasing Inc., Waller, TX (US)

( * ) Notice: Subject to any disclaimer, the term of this patent is extended or adjusted under 35 U.S.C. 154(b) by 0 days.

(21) Appl. No.: 14/164,067

(22) Filed: Jan. 24, 2014

(51) Int. Cl.
*E02F 3/40* (2006.01)
*E02F 5/02* (2006.01)

(52) U.S. Cl.
CPC ..... *E02F 5/025* (2013.01)

(58) Field of Classification Search
USPC ..... 37/273, 274, 411, 443, 444
See application file for complete search history.

(56) References Cited

U.S. PATENT DOCUMENTS

| | | | | |
|---|---|---|---|---|
| 2,113,761 | A | 4/1938 | Joy | |
| 2,556,592 | A | 6/1951 | Markkula | |
| 3,089,261 | A | 5/1963 | Flath | |
| 3,286,377 | A | 11/1966 | Long | |
| 3,805,422 | A | 4/1974 | Stepe | |
| 3,914,884 | A | 10/1975 | Guinot | |
| 3,961,492 | A | 6/1976 | Buehler et al. | |
| 4,614,048 | A | 9/1986 | Melby | |
| 4,691,455 | A | 9/1987 | Newman | |
| 4,704,811 | A | 11/1987 | Jefferson | |
| 5,353,531 | A | 10/1994 | Doucette | |
| 5,638,618 | A | 6/1997 | Niemela et al. | |
| 5,848,654 | A | 12/1998 | Belcher | |
| 5,909,961 | A | 6/1999 | Pullman | |
| 6,994,513 | B2 | 2/2006 | Harris | |
| 7,191,553 | B2 | 3/2007 | Doucette et al. | |
| 7,360,327 | B2 * | 4/2008 | Osgood et al. | 37/444 |
| 7,429,158 | B2 * | 9/2008 | McFarland | 414/722 |
| 7,481,011 | B2 | 1/2009 | Nesseth | |
| 7,584,805 | B2 | 9/2009 | Skaggs | |
| 7,832,128 | B2 | 11/2010 | Doucette et al. | |
| 8,061,063 | B2 | 11/2011 | Gamble | |
| 2004/0140110 | A1 * | 7/2004 | Raup | 172/817 |
| 2011/0094130 | A1 | 4/2011 | Hilton | |

FOREIGN PATENT DOCUMENTS

| | | |
|---|---|---|
| GB | 1134090 | 11/1968 |
| WO PCT/GB2005/000094 | | 8/2005 |

* cited by examiner

*Primary Examiner* — Gary Hartmann
(74) *Attorney, Agent, or Firm* — Antony C Edwards

(57) ABSTRACT

A convertible bucket includes a central support frame. A pair of rigid wings are rotationally mounted on laterally opposite sides of the lower end of the support frame for rotation of each wing between their fully lowered and raised positions. The pair of rigid wings define a wide-mouth width therebetween. In the fully lowered position each wing is substantially horizontal when the support frame is substantially vertical, so that, when the wings are both in their fully lowered position, the wide-mouth width is maximized. A winglet may be mounted at a distal end of each wing so as to provide for containment of a load held in the bucket when at least one wing is in its fully lowered position.

18 Claims, 7 Drawing Sheets

CONVERTIBLE BUCKET HAVING FOLDING WINGS AND WINGLETS

FIELD OF THE INVENTION

This invention relates to the field of buckets for use on a mechanical digging apparatus such as an excavator or grade-all having an articulatable boom, and in particular to a convertible bucket which may be mounted to such a boom.

BACKGROUND OF THE INVENTION

This invention generally relates to the field of mobile equipment for digging ditches, trenches, or the like.

As stated by Newman in his U.S. Pat. No. 4,691,455, which issued to Newman on Sep. 8, 1987 for Trenching Equipment With Hinged Side Plates, in construction and landscaping work it is frequently necessary to dig trenches with walls at angles which vary from the vertical, and many times it is desirable to form a trench wherein each of the side walls thereof are at different angles from the vertical. While there are many prior art devices to form trenches with angled side walls, many are inconvenient to use and, none provide any capability of varying the angle to suit the particular needs of a situation.

Newman thus provided a bucket for a trenching device which can form trenches with walls of varying slope. In particular, Newman discloses a trenching bucket having side plates which are adjustable so that trenches may be formed with walls at various slopes. In FIG. 9 of the Newman patent, the v-shaped trenching bucket is modified to have a floor, plate wherein the side plates are mounted by hinges along the outer edges of the floor plate. Two fan-shaped outer sections are fixed to or formed integral with the ends of the side plates and overlap a stationary, also fan-shaped section which is secured to a support frame. The two fan-shaped outer sections move with the side plates when the orientation of the side plates is adjusted by a corresponding pair of jacks. Newman indicates that the trenches formed by the bucket need not be symmetrical, rather, the side plates may be individually adjusted to provide the desired orientation for each wall of the trench being formed.

What is neither taught nor suggested by Newman is the use of a bucket having adjustable side walls which completely fold outwardly of the center section of the bucket so as to convert the bucket from a bucket which may be merely adjusted to adjust the angles of the walls of the ditches, trenches or the like being excavated, into a larger capacity wide-mouthed bucket, for example, one in which the lower floor of the wide-mouthed bucket is horizontal or almost horizontal across its entire width when placed on level ground, and is therefore well adapted for use in scooping large volumes of loose material.

SUMMARY OF THE INVENTION

This invention relates to an improvement in digging buckets such as used on the end of an arm of a backhoe, excavator, grade-all, tractor, and the like and, particularly, to buckets for such digging equipment in which the side plates or "wings" fold outwardly of the bucket into a substantially horizontal position to thereby provide a wide-mouth bucket As is found in Newman's patent, an open top bucket is provided with adjustable side plates, herein referred to as wings, which are hinged so that the angle of the wings with respect to the vertical can be readily changed by pivoting or otherwise rotating the wings about a corresponding axis of rotation. The bucket may be provided with a base or floor plate and the wings are hingedly connected along the edges of the base or floor plate. The bucket is provided with a back wall which is preferably sectioned with the outer sections fixed to the trailing edge of the wings and fan-shaped in order to form a continuous back wall notwithstanding the inclination of the wings.

The bucket is provided with means to adjust the inclination of the wings, which may be manual actuators such as by means of individual jacks for each wing so that the angle of each can be separately manually adjusted as desired, or may selectively remotely-controlled actuators such as hydraulic cylinders and rods. That is, hydraulic control means may be provided to adjust the angle of the wings and the hand controls for such control means may be conveniently provided along with the other operational controls in the operator's console of the digging machine so that the angle of each wing can be independently, or collectively adjusted as necessary by the operator during digging without dismounting from the digging machine.

In summary then, the convertible bucket described herein may be characterized in one aspect as including a central support frame having an upper end and a lower end and defining an opening therebetween wherein the opening opens forwardly so that a distal end of the support frame is at the front of the bucket and the rear of the support frame is at the rear of the bucket. A pair of rigid wings are pivotally or otherwise rotationally mounted (collectively referred to herein as being pivotally mounted) on laterally opposite sides of the lower end of the support frame for rotation of each wing of the pair of rigid wings between their fully lowered position and their fully raised position. The pair of rigid wings define a wide-mouth width therebetween. In the fully lowered position each wing is substantially horizontal when the support frame is substantially vertical, so that, when the wings are both in their fully lowered position, the wide-mouth width is maximized. In a preferred embodiment a rigid or semi-rigid winglet (collectively referred to herein as a winglet) is mounted at a distal end of each wing so as to provide for containment of a load held in the bucket when at least one wing is in its fully lowered position.

Each winglet may include a longitudinally oriented fence having opposite forward and rear ends. The distal end of each wing each has a longitudinal dimension which extends a longitudinal distance. Each winglet may extend along substantially the entire length of the longitudinal dimension of the distal end of its corresponding wing. Advantageously the winglets each extend from the wings so as to be upstanding from the wings when the wings are in their fully lowered position. In one embodiment, such as illustrated by way of example, the winglets are substantially rectangular. This is not intended to be limiting as other plan form shapes would also work, for example, semi-elliptical, etc. In such an embodiment for example, each winglet has a height dimension which is perpendicular to the winglet's longitudinal dimension. Each wing has a corresponding width dimension which, when measured flush on each wing, is perpendicular to the longitudinal dimension of its winglet. The ratio of height dimension of each winglet to the width dimension of each wing may be in the range of 1:10 to 1:3. Alternatively the range may be is 1:5 to 1:3. In some embodiments the height dimension of each winglet is between 15 and 30 percent of the width dimension of the corresponding wing. The higher the height dimension of each winglet, the lower the ratio, and the greater the load carrying capacity of the wide-mouth bucket when the wings are in their fully lowered position.

In a further preferred embodiment, each wing has the same shape and the same dimensions as the other wing in the pair. For example both wings may be identical. So too, each winglet may be identical. For example, the winglets may have the same dimensions and each winglet may be substantially planar, although, again, this is not intended to be limiting as the winglets may be curved in either or both of horizontal and vertical planes.

In their fully lowered position the pair of rigid wings may be substantially co-planar. As used herein, substantially co-planar is meant to include completely flat, as well as embodiments where the wings are dished or concave to a small extent so that, collectively, the pair of wings when fully lowered form the profile of a "smile" on the front, lower surface of the wide-mouthed bucket. Thus in their fully lowered position, the pair of rigid wings may form a continuously smoothly concave lower surface of the bucket.

In some embodiments the forward end of each winglet coincides with the front of the bucket, and the rear end of each winglet coincides with the rear of the bucket. Also, each winglet may form an included angle relative to its corresponding wing. The included angle may be in the range of 90-135 degrees. In some embodiments the range may be smaller, for example: 90-120 or 100-110 degrees.

When in the fully raised portion, the distal ends of the wings may be advantageously adjacent the upper end of the support frame. The winglets may be substantially flush along the upper end of the support frame.

The lower end of the support frame may include a base plate having laterally spaced apart edges. The pair of rigid wings may be pivotally mounted to the edges of the base plate. At least one selectively controllable actuator may be provided for actuating the pair of rigid wings between their fully lowered and fully raised positions.

Further elements of, and the operation of, and further aspects of the invention will become apparent from the following detailed description when taken in conjunction with the accompanying exemplary drawings.

DETAILED DESCRIPTION OF THE INVENTION

Figure 4:
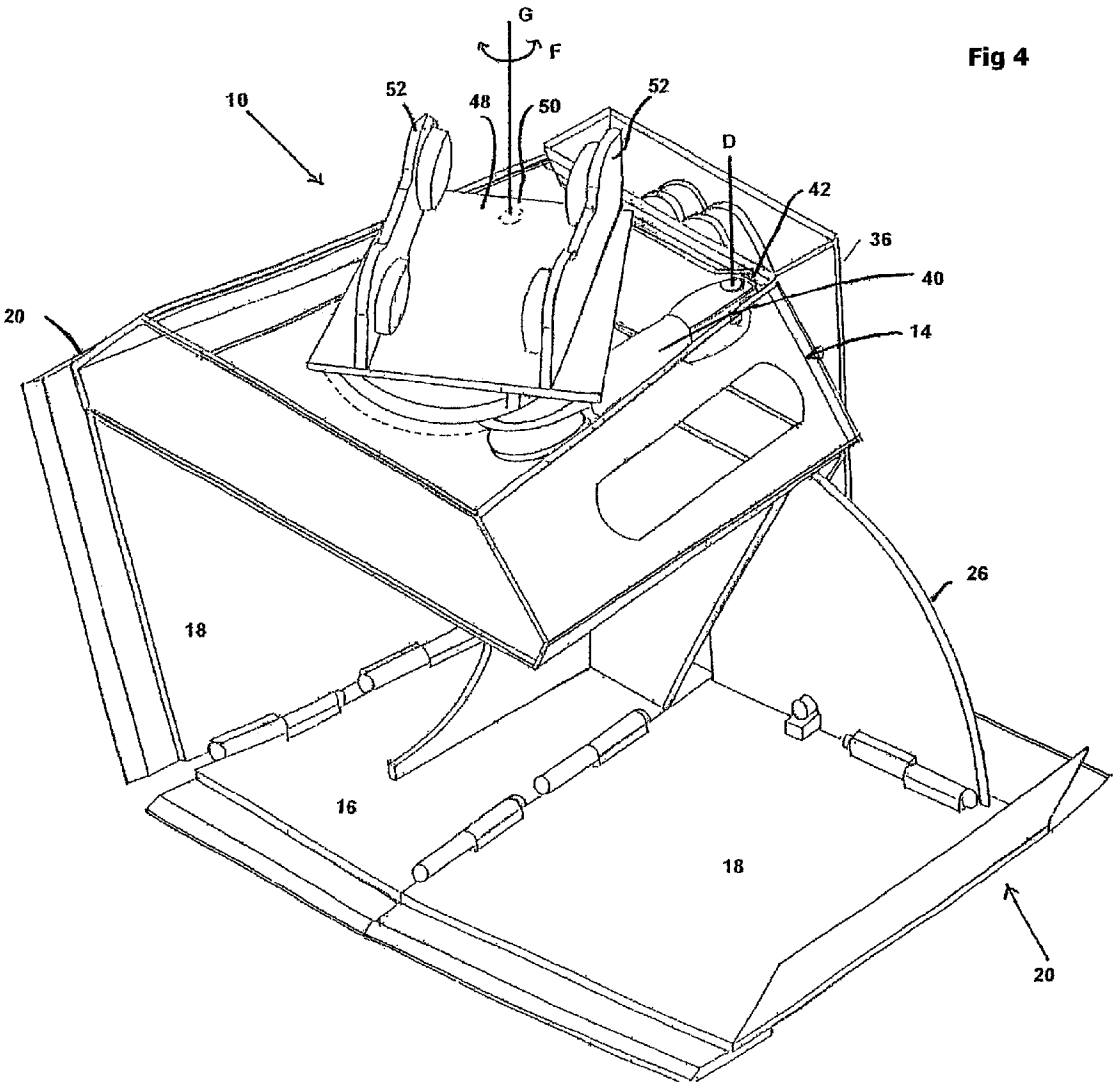
FIG. 4 is, in partially cut away right side top perspective view, the bucket of FIG. 3 with the right wing in its fully lowered position, and the left wing in its fully raised position.
Figure 5:
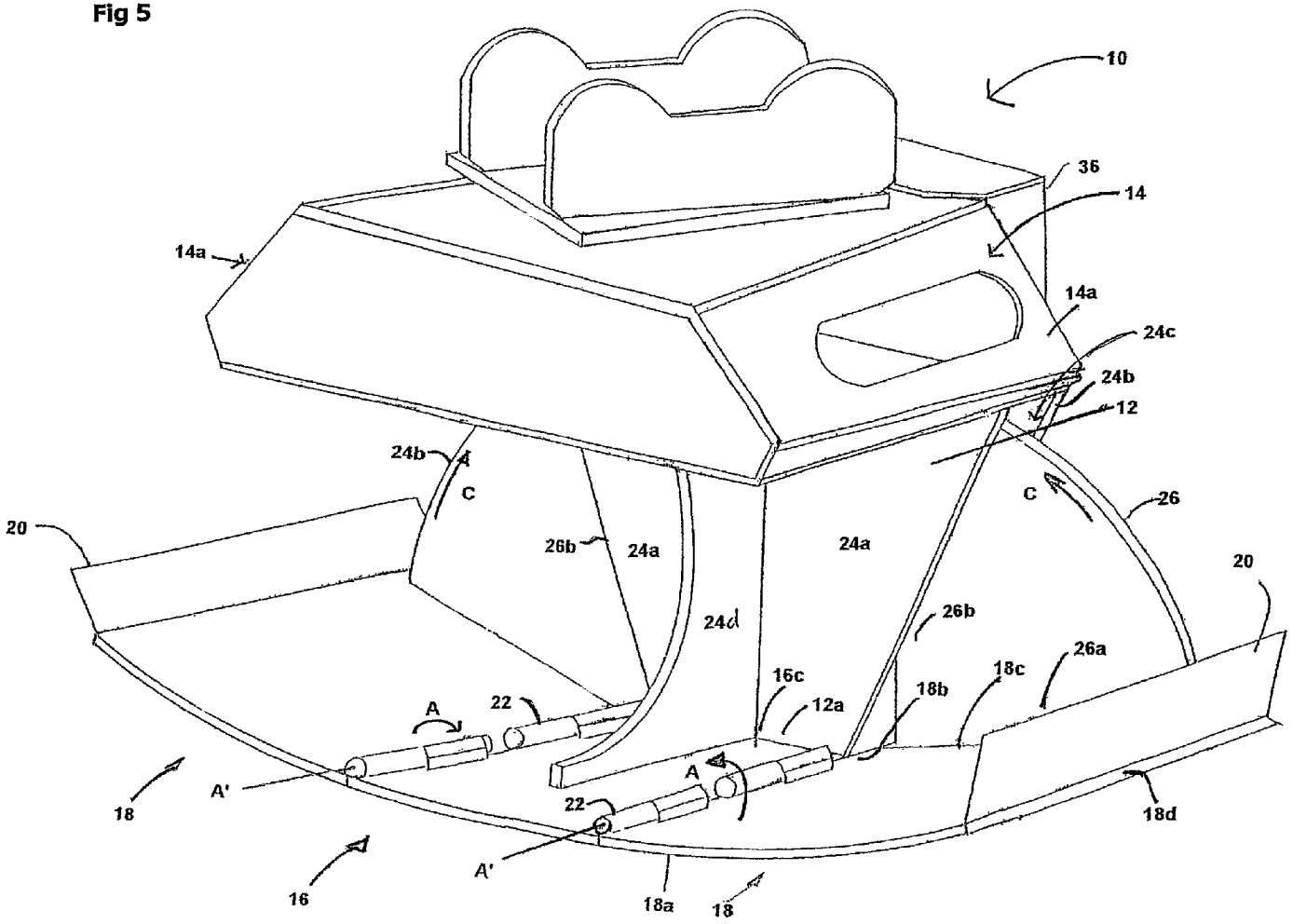
FIG. 5 is the view of FIG. 1 showing one alternative embodiment of the bucket wherein, when the wings are in their fully lowered position, the wide-mouth bucket thereby formed has a lower surface which is dished or concave.
Figure 7:
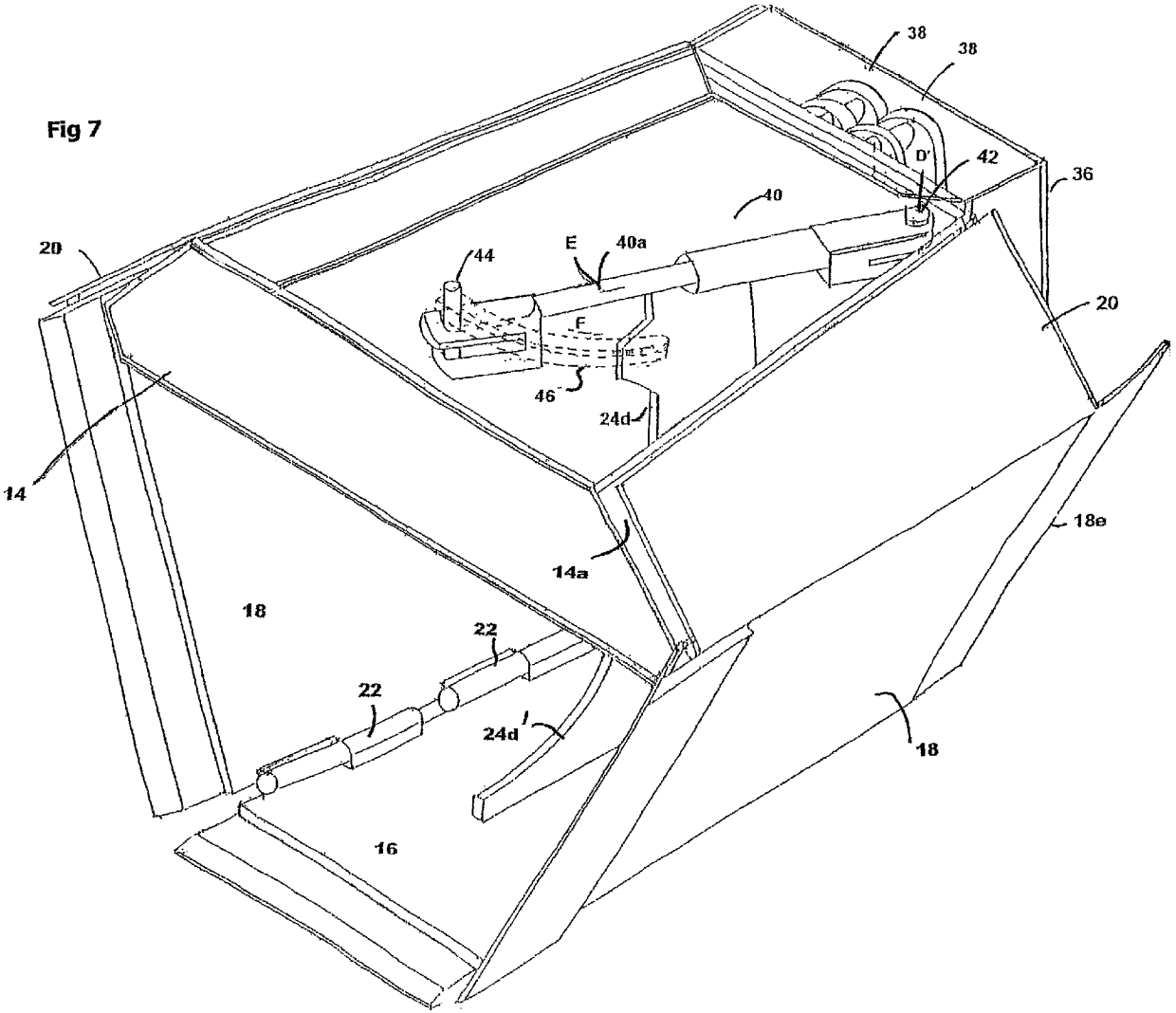
FIG. 7 is, in partially cut away right side top perspective view, the bucket of FIG. 6 with its wings in their fully raised position.

As seen in the accompanying drawing figures wherein like characters of reference denote corresponding parts in each view, convertible bucket 10 includes a central support frame 12 supporting an upper housing 14 over a base 16. An opposed-facing pair of hinged wings 18 are pivotally or hingedly mounted to base 16 so as to pivot between their fully raised position, for example as seen in FIGS. 4 and 7, and the fully lowered position of FIG. 2. Wings 18 pivot between the base 16 and the upper housing 14.

Each wing 18 has a front edge 18*a*, a lower edge 18*b*, a rear edge 18*c* and an upper edge 18*d*. Winglets 20 are advantageously provided. Winglets 20 are mounted to the upper edges 18*d* of both wings 18 so as to be cantilevered therefrom, advantageously substantially along the full length of upper edge 18*d* of each wing 18, to thereby project upwardly when wings 18 are in their fully lowered position, and so as to lay flush along, or adjacent to, the sidewall 14*a* on each side of housing 14 when wings 18 are in their fully raised position.

Central support frame 12 has an upper end 12*a* and an opposite, lower end 12*b*. Upper end 12*a* may include housing 14. Central support frame 12 may include forward and rear wedge-shaped plates 24*a* and 24*b* mounted to rear end 16*c* of base 16. A longitudinally extending support brace 24*d* bisects each of the pairs of wedge-shaped plates 24*a* and 24*b*. Wedge shaped plates 24*a* and 24*b* may for example be spaced apart and parallel and form a cavity 24*c* there-between. Sector-shaped rear walls 26 are mounted at their lower most edges 26*a* to the corresponding rear edges 18*c* of wings 18. Rear walls 26 may extend orthogonally from wings 18 so as to extend their interior edges 26*b* into cavity 24*c* between wedge-shaped plates 24*a* and 24*b* on either side of brace 24*d*. Rear walls 26 rotate in direction C as wings 18 rotate in direction A so as to house rear walls 26 within cavities 24*c*.

Figure 1:
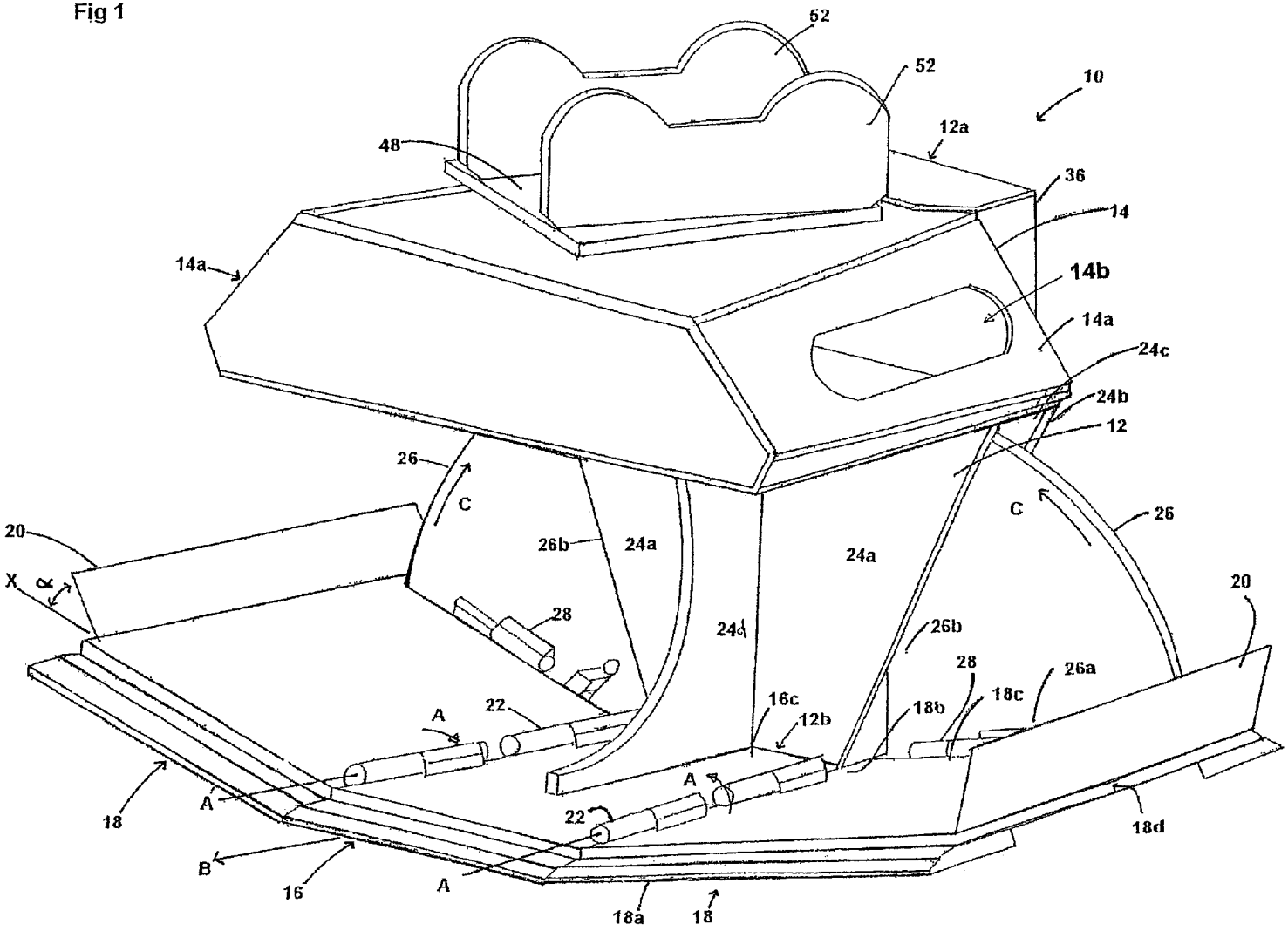
FIG. 1 is in right side perspective view, the convertible bucket as further described below with its wings almost completely lowered into their fully lowered position.

Thus as wings 18 rotate in directions A as seen in FIG. 1, they rotate about axis of rotation A' on hinges 22 from their fully lowered position to their fully raised position. In either the raised or lowered positions, wings 18 allow bucket 10 to be used to dig or scoop in direction B. When wings 18 are fully or partially raised bucket 10 may be used for example to dig ditches or the like (and the slopes may be adjusted as done in the prior art) and when wings 18 are fully lowered or substantially fully lowered (for example as in FIG. 1), bucket 10 may be used as a wide-mouthed bucket for efficiently scooping and moving more voluminous loads.

In one embodiment, not intended to be limiting, rear walls 26 may be mounted to the rear edges 18*c* of wings 18 by means of hinges 28. In other embodiments, rear walls 26 are rigidly mounted to wings 18.

Figure 2:
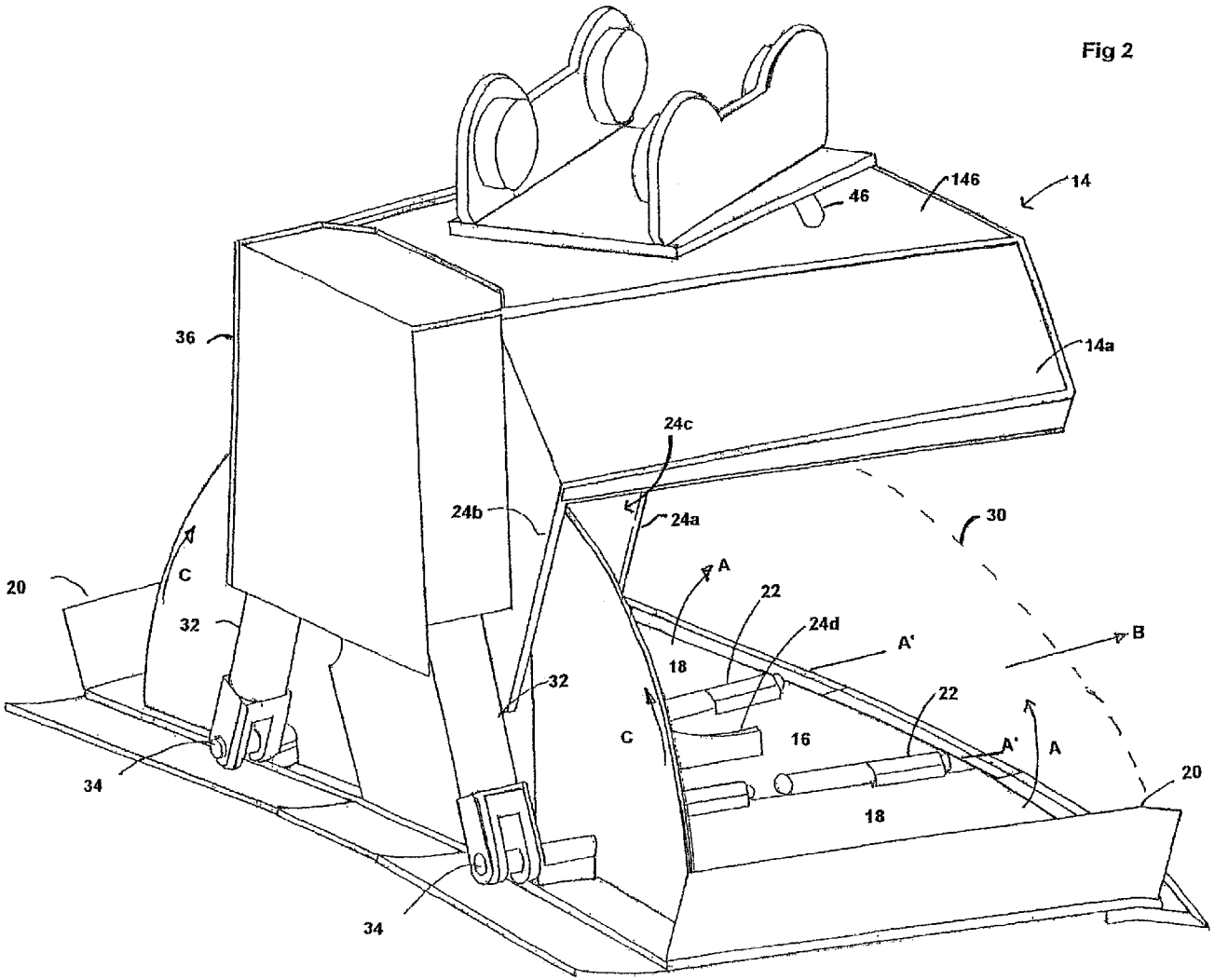
FIG. 2 is, in left side rear perspective view, the bucket of FIG. 1 with its wings in their fully lowered position.
Figure 3:
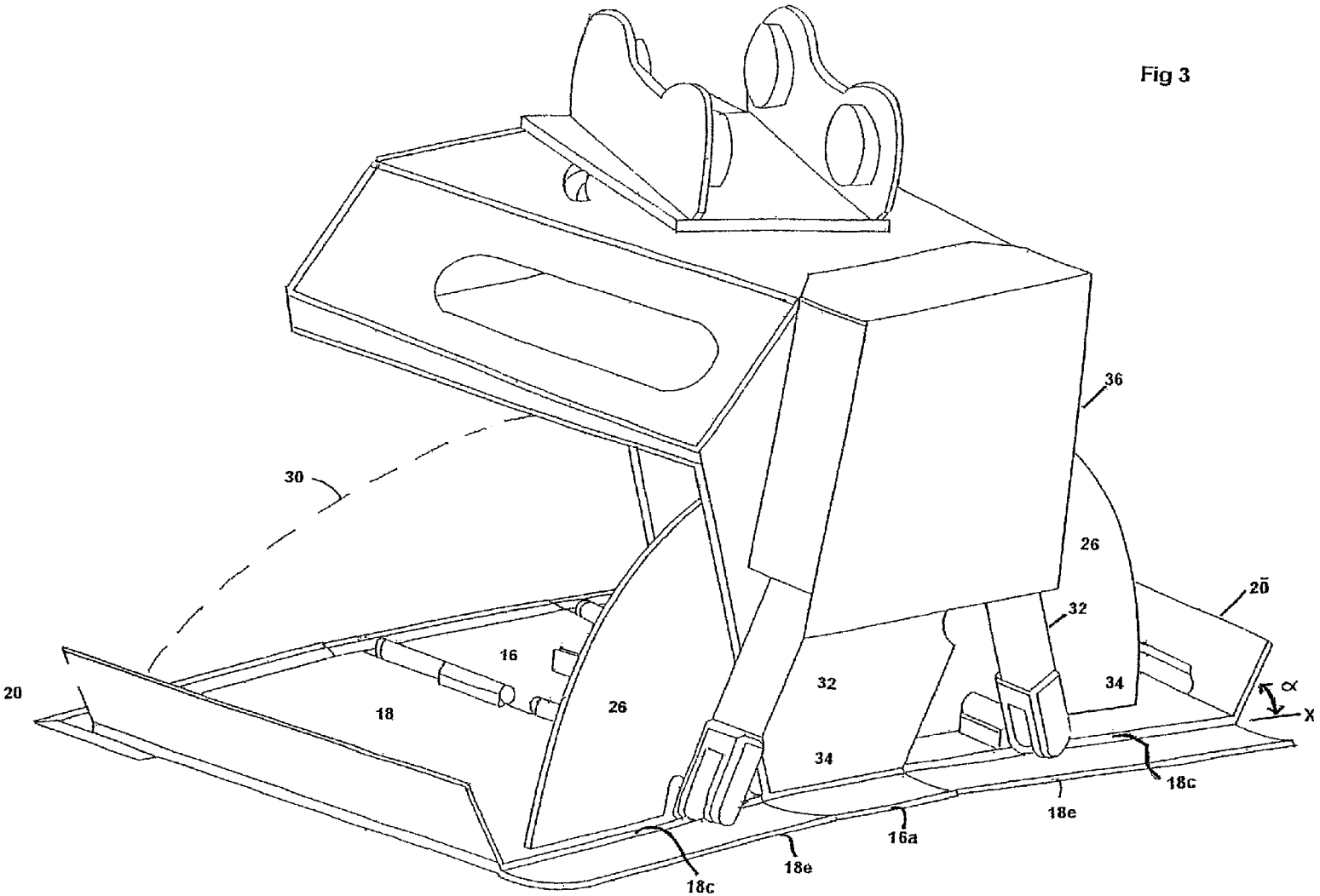
FIG. 3 is, in right side rear perspective view, the bucket of FIG. 2.
Figure 6:
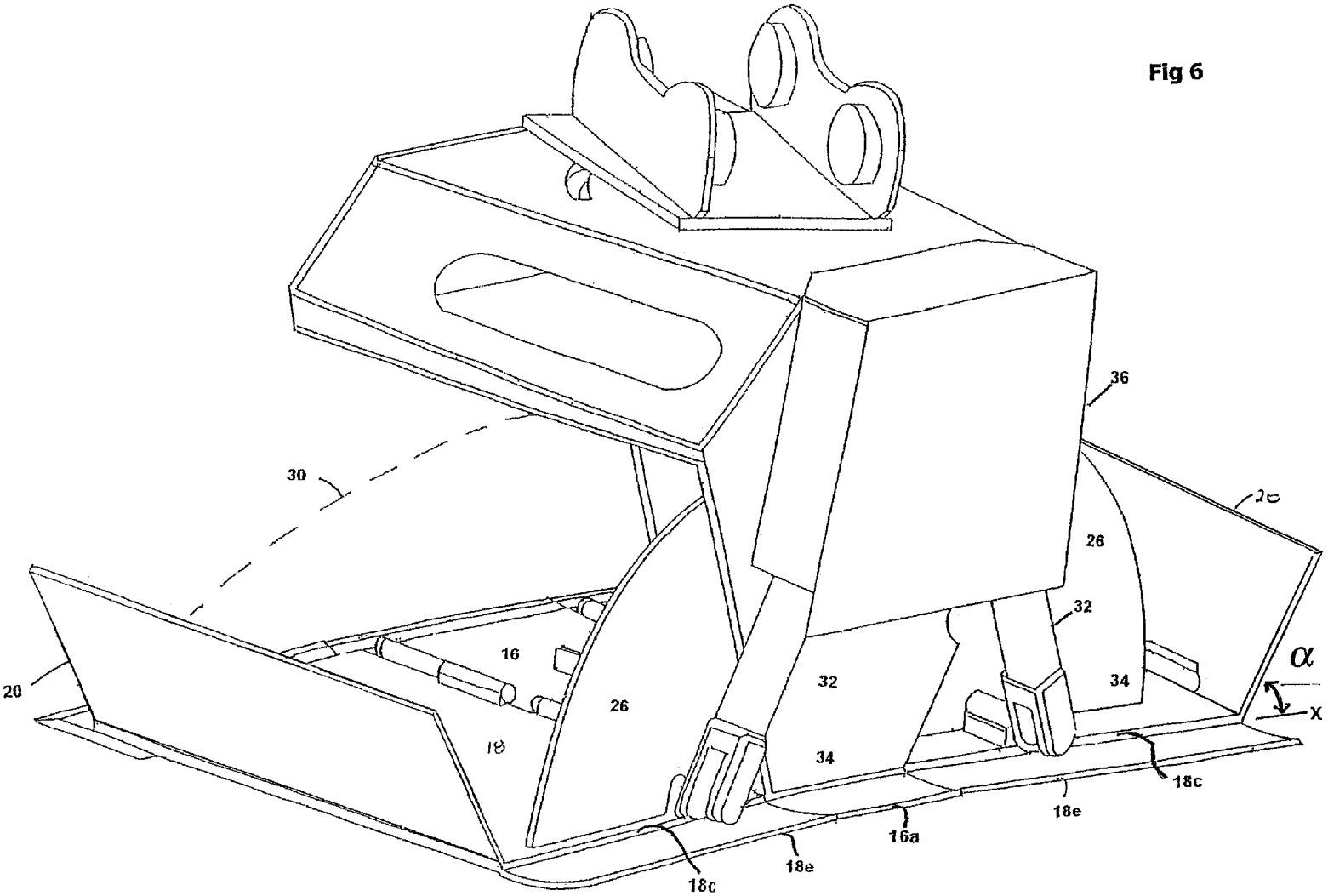
FIG. 6 is the view of FIG. 3 wherein the winglets are enlarged so as to have greater height when the wings are in their fully lowered position.

Winglets 20 project from the distal ends or outer edges 18*d* of wings 18 so as to form a load-holding fence along the wings' distal ends. As illustrated, but without intending to be limiting, winglets 20 may extend upwardly at an acute angle alpha relative to the horizontal plane x. Thus the included angles between the wings and corresponding winglets are 90 degrees or greater. In the embodiment of FIGS. 2 and 3, wings 18 and base 16 substantially lie in plane x when wings 18 are in their fully lowered position. Angle alpha is such that winglets 20 provide a fence along the laterally opposite sides of bucket 10 when bucket 10 is in its wide-mouthed orientation, that is, when wings 18 are fully lowered. Winglets 20 thereby assist in holding the load (shown in dotted outline as load 30) which has been scooped or gathered into the bucket, for example a load of earth, sand or gravel, so as to thereby increase the volume of the load that may be held and carried within bucket 10 in its wide-mouthed orientation. The fence function provided by winglets 20 inhibit the load 30 spilling off the distal ends of wings 18, that is spilling off outer edges 18*d*. The winglets may provide a shorter fence as seen in FIGS. 1-5, or may provide a fence with greater height as seen in FIG. 6, the latter providing a greater capacity for the bucket.

Actuators 32, which may for example be hydraulic actuators, are pivotally mounted to rear edges 18*c* of wings 18 by means of hinges or pivot joints 34. Actuators 32 may be contained within an actuator housing 36, illustrated by way of example as covering the upper ends of actuators 32. As seen in FIG. 7, the upper ends of actuators 32 are pivotally mounted by means of hinges or pivot joints 38 at an apex formed by the upwardly and inwardly inclined pair of actuators 32. The lower hinges or pivot joints 34 may be protected by rearwardly extending flanges such as rearwardly extending flanges 18*e* extending rearwardly, and in a substantially coplanar relationship with, wings 18, and rearwardly extending flange 16*a* extending rearwardly, and substantially coplanar relationship with, base 16.

In the fully raised position seen in FIGS. 4 and 7, the outer edges 18*d* of wings 18 abut against and along the lower-most edges of sidewalls 14*a* of upper housing 14 and winglets 20 are flush against or adjacent and substantially parallel to sidewalls 14*a*.

Winglets 20 may be sized to fit snuggly onto, so as to overlay, sidewalls 14*a*. The flush mounting of winglets 20 onto sidewalls 14*a* assists in stabilizing wings 18 and to help relieve bending moments acting on hinges 22 when the bucket is being used to excavate hard or rocky ground. Winglets 20 may include raised surfaces (not shown) which releasably mate into cut-outs 14*b* in sidewalls 14*a* to further assist in releasably locking the winglets 20, and thus also supporting wings 18, in their fully raised positions.

In FIG. 7, the upper and lower surfaces of housing 14 have been removed to show, respectively, actuator 40 and the upper-most end of brace 24*d*. Actuator 40 is pivotally mounted on pivot joint 42 for rotation about vertical axis of rotation D. Actuator 40 rotates about axis D as extension or retraction of actuator rod 40*a* in direction E causes cam follower 44 to follow the curve in direction F along the arcuate slot 46 shown in dotted outline. Slot 46 is formed in the upper wall 14*b* of housing 14. As seen in FIG. 4, cam follower 44 is mounted to the bottom surface of hanger plate 48. Hanger plate 48 is pivotally mounted for rotation in a plane horizontal to upper wall 14*b* by means of a pivot joint 50 shown in dotted outline in FIG. 4 for rotation in direction F about vertical axis of rotation G. Hanger plate 48 is thus rotated about pivot joint 50 and axis G by the extension and retraction of rod 40*a* of actuator 40. Thus as seen in FIG. 4, with rod 40*a* fully retracted, plate 48 is fully rotated to the right hand side of bucket 10 which in FIG. 4 corresponds to the side of bucket 10 shown with one lowered wing 18.

Ears 52 are rigidly mounted down onto plate 48 so that, with ears 52 also mounted to the distal end of the arm (not shown) of an excavator, rotation of plate 48 about axis of rotation G or the like will rotate bucket 10 relative to the excavator arm. Thus an operator selectively controlling actuator 40 thereby selectively controls the rotation and positioning of bucket 10 about axis G relative to the excavator arm. The rotating top or plate 48 thus creates an adjustable or variable offset which gives an operator the ability to move his digging/trenching machine toward or away from the ditch/trench bottom while adjusting the angle so as to always dig straight along the ditch/trench. Conventionally, often obstacles will prohibit the operator from appropriate or optimally positioning the machine requiring the operator to move toward or away from the bottom of the ditch/trench as the operator digs. As used herein the term excavator is intended to include heavy equipment which operates buckets at the end of actuable arms so as to include excavators, Grade-alls™ back hoes, tractors etc.

What is claimed is:

1. A variable width bucket comprising a central support frame having an upper end and a lower end and defining an opening therebetween wherein said opening opens forwardly so that a distal end of said support frame is at a front of said bucket and a rear of said support frame is at a rear of said bucket opposite said front, a pair of rigid wings pivotally mounted on laterally opposite sides of said lower end of said support frame for rotation of each wing of said pair of rigid wings between a fully lowered position and a fully raised position, said pair of rigid wings defining a mouth width therebetween, wherein, in said fully lowered position said each wing is substantially horizontal when said support frame is substantially vertical, so that, when said each wing in said pair of rigid wings are both in said fully lowered position, said mouth width is maximized, and wherein a winglet is mounted at a distal end of said each wing so as to provide for containment of a load held in said bucket when at least one of said each wing is in said fully lowered position.

2. The bucket of claim 1 wherein each said winglet includes a longitudinally oriented fence having opposite forward and rear ends, and wherein said distal end of said each wing each has a longitudinal dimension which extends a longitudinal distance, and wherein each said winglet extends along substantially the entire length of said longitudinal dimension of said distal end of a corresponding said wing.

3. The bucket of claim 2 wherein said winglets each extend from said wings so as to be upstanding from said wings when in said fully lowered position.

4. The bucket of claim 3 wherein said winglets are substantially rectangular.

5. The bucket of claim 4 wherein said winglets have a height dimension perpendicular to said longitudinal dimension, and wherein said each wing has a width dimension which, when measured flush on said each wing, is perpendicular to said longitudinal dimension, and wherein a ratio of said height dimension of said each winglet to said width dimension of said each wing is in the range of 1:10 to 1:3.

6. The bucket of claim 5 wherein said range is 1:5 to 1:3.

7. The bucket of claim 6 wherein said height dimension is between 15 and 30 percent of said width dimension.

8. The bucket of claim 7 wherein said each wing of said pair of rigid wings each have the same shape and the same said dimensions.

9. The bucket of claim 8 wherein said each wing and said each winglet is substantially planar, so that, in said fully lowered position said pair of rigid wings are substantially co-planar.

10. The bucket of claim 8 wherein said each wing is dished, and wherein, in said fully lowered position, said pair of rigid wings form a continuously smoothly concave lower surface of said bucket.

11. The bucket of claim 8 wherein said forward end of said each winglet coincides with said front of said bucket, and said rear end of said each winglet coincides with said rear of said bucket.

12. The bucket of claim 1 wherein said each winglet forms an included angle relative to a corresponding said wing of said pair of rigid wings, and wherein said included angle is in the range of 90-135 degrees.

13. The bucket of claim 2 wherein said included angle is in the range 90-120 degrees.

14. The bucket of claim 3 wherein said included angle is in the range of 100-110 degrees.

15. The bucket of claim 4 wherein, when in said fully raised portion, said distal ends of said wings are adjacent said upper end of said support frame, and said winglets are substantially flush along said upper end of said support frame.

16. The bucket of claim 15 further comprising a selectively pivotable hanger mount on said upper end of said support frame.

17. The bucket of claim 16 wherein said lower end of said support frame includes a base plate having laterally spaced apart edges, and wherein said pair of rigid wings are said pivotally mounted to said edges of said base plate.

18. The bucket of claim 17 further comprising at least one selectively controllable actuator for actuating said pair of rigid wings between said fully lowered and fully raised positions.

* * * * *